US008883288B2

(12) United States Patent
Gaeta et al.

(10) Patent No.: US 8,883,288 B2
(45) Date of Patent: Nov. 11, 2014

(54) ABRASIVE ARTICLE WITH ADHESION PROMOTING LAYER

(75) Inventors: Anthony C. Gaeta, Lockport, NY (US); Paul S. Goldsmith, Wayland, MA (US); Kamran Khatami, East Greenwich, RI (US); Pranjal Shah, Nashua, NH (US)

(73) Assignees: Saint-Gobain Abrasives, Inc., Worcester, MA (US); Saint-Gobain Abrasifs, Conflans-Sainte-Honorine (FR)

( * ) Notice: Subject to any disclaimer, the term of this patent is extended or adjusted under 35 U.S.C. 154(b) by 927 days.

(21) Appl. No.: 12/184,815

(22) Filed: Aug. 1, 2008

(65) Prior Publication Data

US 2009/0041983 A1 Feb. 12, 2009

Related U.S. Application Data

(60) Provisional application No. 60/953,915, filed on Aug. 3, 2007.

(51) Int. Cl.

| | |
|---|---|
| ***B32B 5/00*** | (2006.01) |
| ***B24D 3/20*** | (2006.01) |
| ***B24D 11/08*** | (2006.01) |

(52) U.S. Cl.

CPC . *B24D 11/08* (2013.01); *B24D 3/20* (2013.01)
USPC ..... 428/143; 428/141; 428/480; 51/297; 51/298; 51/307; 451/526; 451/533; 451/539

(58) Field of Classification Search

USPC ..... 428/141, 143, 480, 323, 327; 51/295, 51/297, 298, 299; 451/526, 528, 533, 539
See application file for complete search history.

(56) References Cited

U.S. PATENT DOCUMENTS

| | | | | |
|---|---|---|---|---|
| 5,286,541 | A * | 2/1994 | Darjee et al. | 428/40.9 |
| 5,304,224 | A | 4/1994 | Harmon | |
| 5,344,688 | A | 9/1994 | Peterson et al. | |
| 5,355,636 | A | 10/1994 | Harmon | |
| 5,391,210 | A | 2/1995 | Bilkadi et al. | |
| 5,580,634 | A | 12/1996 | Stout et al. | |
| 5,584,897 | A | 12/1996 | Christianson et al. | |

(Continued)

FOREIGN PATENT DOCUMENTS

| | | |
|---|---|---|
| EP | 0549948 A1 | 7/1993 |
| EP | 0590670 A1 | 4/1994 |

(Continued)

OTHER PUBLICATIONS

PCT/US2008/071968, International Search Report mailed Nov. 7, 2008, 2 pages.

(Continued)

*Primary Examiner* — Maria Veronica Ewald
*Assistant Examiner* — Nancy Johnson
(74) *Attorney, Agent, or Firm* — Joseph P. Sullivan; Abel Law Group, LLP

(57) ABSTRACT

An abrasive article includes a backing having a major surface, an adhesion promoting layer overlying the major surface of the backing, and a make layer directly contacting the adhesion promoting layer. The adhesion promoting layer has a thickness of at least about 10 microns and is formed of a polar thermoplastic material, a cross-linkable polymer, or blends thereof.

11 Claims, 3 Drawing Sheets

(56) References Cited

U.S. PATENT DOCUMENTS

| | | | | |
|---|---|---|---|---|
| 5,603,170 | A | 2/1997 | Hirai | |
| 5,626,639 | A | 5/1997 | King | |
| 5,763,075 | A | 6/1998 | Benjamin et al. | |
| 5,766,277 | A | 6/1998 | DeVoe et al. | |
| 5,830,248 | A | 11/1998 | Christianson et al. | |
| 5,902,441 | A | 5/1999 | Bredt et al. | |
| 5,910,471 | A | 6/1999 | Christianson et al. | |
| 6,126,528 | A | 10/2000 | Sedlock | |
| 6,217,413 | B1 | 4/2001 | Christianson | |
| 6,432,549 | B1 | 8/2002 | Kronzer | |
| 6,657,001 | B1 | 12/2003 | Anderson et al. | |
| 6,660,828 | B2 | 12/2003 | Thomas et al. | |
| 6,755,878 | B2 | 6/2004 | Paxton et al. | |
| 6,758,734 | B2 | 7/2004 | Braunschweig et al. | |
| 6,773,474 | B2 | 8/2004 | Koehnle et al. | |
| 6,797,023 | B2 | 9/2004 | Knapp et al. | |
| 6,905,772 | B2 | 6/2005 | Shoup et al. | |
| 6,929,539 | B2 | 8/2005 | Schutz et al. | |
| 6,936,083 | B2 | 8/2005 | Thurber et al. | |
| 7,022,801 | B2 | 4/2006 | Medsker | |
| 7,087,710 | B2 | 8/2006 | Medsker et al. | |
| 7,497,884 | B2 | 3/2009 | Lindquist et al. | |
| 2003/0109662 | A1 | 6/2003 | Medsker et al. | |
| 2003/0143938 | A1 | 7/2003 | Braunschweig et al. | |
| 2004/0029511 | A1 * | 2/2004 | Kincaid et al. | 451/526 |
| 2004/0048957 | A1 | 3/2004 | Medsker et al. | |
| 2004/0152799 | A1 | 8/2004 | Miller et al. | |
| 2004/0242804 | A1 | 12/2004 | Medsker et al. | |
| 2005/0019574 | A1 | 1/2005 | McCrary | |
| 2005/0020190 | A1 | 1/2005 | Schutz et al. | |
| 2005/0025967 | A1 | 2/2005 | Lawton et al. | |
| 2005/0032469 | A1 | 2/2005 | Duescher | |
| 2005/0069714 | A1 | 3/2005 | Hart et al. | |
| 2005/0100739 | A1 | 5/2005 | Thurber et al. | |
| 2005/0262773 | A1 | 12/2005 | Schutz et al. | |
| 2006/0026905 | A1 | 2/2006 | Kim | |
| 2006/0143989 | A1 * | 7/2006 | Lindquist et al. | 51/298 |
| 2006/0145127 | A1 * | 7/2006 | Lockridge | 252/500 |
| 2006/0148390 | A1 | 7/2006 | Woo et al. | |
| 2006/0148642 | A1 | 7/2006 | Ryu et al. | |
| 2006/0154082 | A1 | 7/2006 | Miller et al. | |
| 2006/0234901 | A1 | 10/2006 | Scheuing et al. | |
| 2007/0243798 | A1 | 10/2007 | Annen et al. | |
| 2009/0035519 | A1 | 2/2009 | Gaeta et al. | |
| 2009/0041983 | A1 | 2/2009 | Gaeta et al. | |
| 2009/0325466 | A1 | 12/2009 | Kincaid et al. | |

FOREIGN PATENT DOCUMENTS

| | | | |
|---|---|---|---|
| EP | 0851800 | B1 | 6/2002 |
| EP | 1312655 | A2 | 5/2003 |
| EP | 1163308 | B1 | 10/2004 |
| EP | 1487612 | B1 | 4/2006 |
| EP | 1194495 | B1 | 8/2006 |
| EP | 2185321 | A1 | 2/2009 |
| WO | 92/01536 | A1 | 2/1992 |
| WO | 97/10924 | A1 | 3/1997 |
| WO | 97/42006 | A1 | 11/1997 |
| WO | 99/11430 | A1 | 3/1999 |
| WO | 02/34848 | A1 | 5/2002 |
| WO | 02074839 | A | 9/2002 |
| WO | 03/089194 | A1 | 10/2003 |
| WO | 03089194 | A1 | 10/2003 |
| WO | 2004/013231 | A1 | 2/2004 |
| WO | 2004/067599 | A1 | 8/2004 |
| WO | 2005026229 | A1 | 3/2005 |
| WO | 2005/047358 | A1 | 5/2005 |
| WO | 2006/043072 | A1 | 4/2006 |
| WO | 2006074058 | A1 | 7/2006 |
| WO | 2006/083688 | A1 | 8/2006 |
| WO | 2008/079932 | A2 | 7/2008 |
| WO | 2009/020870 | A1 | 2/2009 |
| WO | 2010/002697 | A2 | 1/2010 |
| WO | 2011/150326 | A2 | 12/2011 |

OTHER PUBLICATIONS

PCT/US2011/038328, International Search Report mailed Jan. 19, 2012, 2 pages.

Norton, "Sheets—Black Ice T214 Waterproof Paper", Accessed Nov. 10, 2011, 1 page.

3M Industrial Adhesives and Tapes Division, Material Safely Data Sheet: 3M™ Scotch(r) and Tartan™ Box Sealing Tapes—Rubber Adhesive Series (255, 351, 353, 355, 369, 371, 372, 373, 375, 3331, 3721, 3723, Aug. 19, 2010.

Natural Rubber, Polymers: A Property Database, CRC Press. 2000. http://db.polymersnetbase.com/polymer/polymer-frame.asp?entry-id=363.

The Dow Chemical Company, Amplify EA Functional Polymers, 2013, 1 page.

Lotader, Lotader® 3210, Sep. 2010, France, 1 page.

Arkema, Lotryl™ 16 MA 003, Jul. 2004, 2 pages.

The Dow Chemical Company, Amplify™ EA 101, 2012, 3 pages.

MatWeb Material Property Data, "Eastman SP 2207 EMAC® Ethylene-Methyl Acrylate Copolymer", 2013.

Arkema, Lotader® 3210, Jul. 2004, 2 pages.

Lyondellbasell Material Safety Data Sheet, Aquathene AQ120000, 2012, 9 pages.

MatWeb Material Property Data, "Dow Nordel® NDR 4820P EPDM Hydrocarbon Rubber", 2013, 2 page.

Polypropylne/rubber blend, Polymers: A Property Database, CRC Press. 2000. http://db.polymersnetbase.com/polymer/polymer-frame.asp?entry-id=1191.

* cited by examiner

ABRASIVE ARTICLE WITH ADHESION PROMOTING LAYER

CROSS-REFERENCE TO RELATED APPLICATIONS

The present application claims priority from U.S. Provisional Patent Application No. 60/953,915 filed Aug. 3, 2007, entitled "ABRASIVE ARTICLE WITH ADHESION PROMOTING LAYER," naming inventors Anthony C. Gaeta, Paul S, Goldsmith, and Kamran Khatami, which application is incorporated by reference herein in its entirety.

FIELD OF THE DISCLOSURE

This disclosure, in general, relates to abrasive articles that have an adhesion promoting layer.

BACKGROUND

Abrasive articles, such as coated abrasives and bonded abrasives, are used in various industries to machine workpieces, such as by lapping, grinding, or polishing. Machining utilizing abrasive articles spans a wide industrial scope from optics industries, automotive paint repair industries, to metal fabrication industries. In each of these examples, manufacturing facilities use abrasives to remove bulk material or affect surface characteristics of products.

Surface characteristics include shine, texture, and uniformity. For example, manufacturers of metal components use abrasive articles to fine polish surfaces, and oftentimes desire a uniformly smooth surface. Similarly, optics manufacturers desire abrasive articles that produce defect free surfaces to prevent light diffraction and scattering. Hence, the abrasive surface of the abrasive article generally influences surface quality.

Typically, the abrasive surface of the abrasive article is coated onto the backing of the abrasive article. The abrasive layer is typically coated as a make coat which includes a binder and abrasive grains embedded within the binder. Unfortunately, poor adhesion of the abrasive layer to the backing can lead to the degradation of the abrasive article and influence performance. Hence, the useful life of the abrasive article is compromised. As such, backings are typically primed to increase the adhesion of the abrasive layer to the backing. Although primers on the backing of the abrasive article enhance adhesion, the brittle make coat can delaminate or flake-off, resulting in the degradation of the abrasive article.

As such, an improved abrasive product and a method of forming an improved abrasive product would be desirable.

SUMMARY

In a particular embodiment, an abrasive article includes a backing having a major surface, an adhesion promoting layer overlying the major surface of the backing, and a make layer directly contacting the adhesion promoting layer. The adhesion promoting layer has a thickness of at least about 10 microns and is formed of a polar thermoplastic material, a cross-linkable polymer, or blends thereof.

In an embodiment, an abrasive article includes a backing having a major surface, an adhesion promoting layer overlying the major surface of the backing, and a make layer directly contacting the adhesion promoting layer. The adhesion promoting layer has a thickness of at least about 10 microns and is formed of a copolymer including at least one ethylene monomer and at least one monomer of acrylic acid, ethyl acrylic acid, or methyl acrylic acid.

In another embodiment, an abrasive article includes a backing having a major surface, an adhesion promoting layer overlying the major surface of the backing, and make layer directly contacting the adhesion promoting layer. The adhesion promoting layer has a thickness of at least about 10 microns and is formed of a maleic anhydride modified polyolefin.

In another embodiment, a method of forming an abrasive article includes coating an adhesion promoting layer on a major surface of a backing and coating a binder formulation directly on the adhesion promoting layer. The adhesion promoting layer has a thickness of at least about 10 microns and is formed of a polar thermoplastic material, a cross-linkable polymer, or blends thereof.

BRIEF DESCRIPTION OF THE DRAWINGS

The present disclosure may be better understood, and its numerous features and advantages made apparent to those skilled in the art by referencing the accompanying drawing.

DESCRIPTION OF THE DRAWINGS

In a particular embodiment, an abrasive article includes a backing having a major surface and an adhesion promoting layer disposed over the major surface. In an exemplary embodiment, the adhesion promoting layer may be disposed directly on and directly contact the major surface of the backing without any intervening layers or tie layers. In another embodiment, the backing may be surface treated, chemically treated, primed, or any combination thereof. The abrasive article further includes an abrasive layer disposed directly on and directly contacting a major surface of the adhesion promoting layer. In an exemplary embodiment, the abrasive layer may directly contact the major surface of the adhesion promoting layer without any intervening layers or tie layers between the major surface of the adhesion promoting layer and the abrasive layer. The adhesion promoting layer provides desirable adhesion of the abrasive layer to the backing as well as provides an abrasive article with a desirable surface finish.

Figure 1:
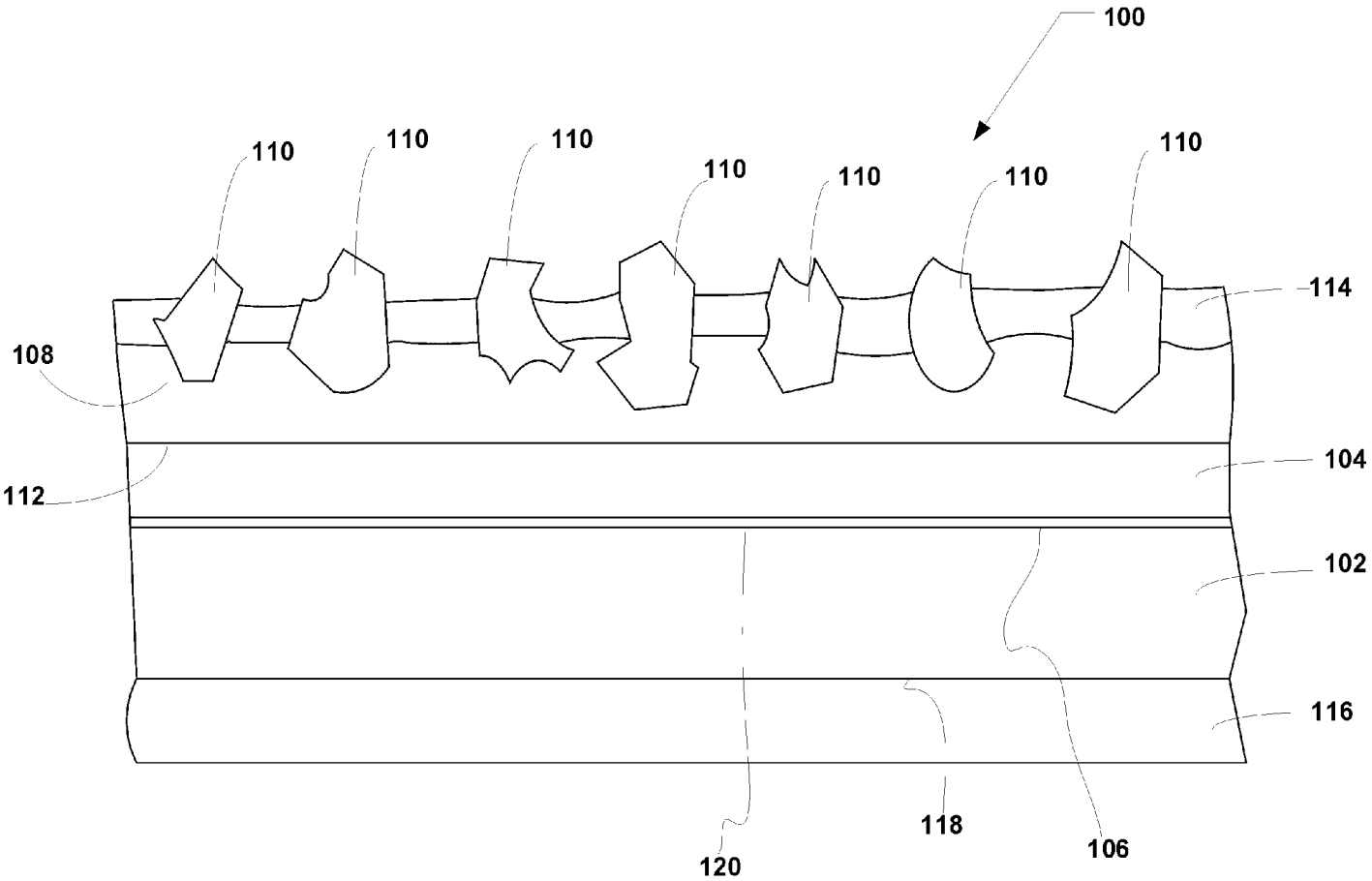
FIG. 1 includes an illustration of an exemplary coated abrasive article.

An exemplary embodiment of a coated abrasive article 100 is illustrated in FIG. 1. The coated abrasive includes a backing 102 and the adhesion promoting layer 104 disposed over a major surface 106 of the backing 102. Further, disposed on the adhesion promoting layer 104 is an abrasive layer 108, in contact with abrasive grains 110. The abrasive layer 108, such as a make coat layer, is disposed on major surface 112 of the adhesion promoting layer 104. Further, the coated abrasive 100 may include a size coat 114 or a supersize coat (not shown). In addition, the coated abrasive may include a backsize layer 116 disposed over a second major surface 118 of the backing 102. In a particular embodiment, the coated abrasive article 100 may include a primer layer 120 disposed between the adhesion promoting layer 104 and the backing 102.

In an exemplary embodiment, the adhesion promoting layer 104 is formed from a polar thermoplastic material. In an example, the polar thermoplastic material includes a polar functional group that is compatible with the backing material or treated backing material. In an exemplary embodiment, the polar thermoplastic material is fully polymerized and does not further cure after coating. In a particular embodiment, the polar thermoplastic material is a copolymer including at least one ethylene monomer and at least one monomer of acrylic acid, ethyl acrylic acid, or methyl acrylic acid. An exemplary copolymer may include ethylene acrylic acid, ethylene ethylacrylic acid, ethylene methylacrylic acid, or any combination thereof. Further, the copolymer may be modified with a functional group such as an ionomer, an epoxy component, a maleic anhydride component, or any combination thereof.

In yet another embodiment, the polar thermoplastic material includes a thermoplastic epoxy component. The polar thermoplastic material may also include modified polyolefins, such as polyolefins modified with an anhydride component. Exemplary anhydride modified polyolefins include maleic anhydride modified polypropylene, maleic anhydride modified polyethylene, and maleic anhydride ethylene copolymers.

In an embodiment, the polar thermoplastic material of the adhesion promoting layer 104 is at least about 50 weight % of the total weight of the adhesion promoting layer 104, such as at least about 60 weight %, at least about 70 weight %, at least about 75 weight %, or at least about 80 weight % of the total weight of the adhesion promoting layer 104. The adhesion promoting layer 104 may also include optional components such as fillers and colorants, stabilizers, flame retardants, adhesion promoters, or any combination thereof.

In an embodiment, the adhesion promoting layer is a formed from any suitable cross-linkable polymer system. For instance, the cross-linkable polymer system includes vinyl silane copolymers, such as ethylene vinyl silane copolymer. In another embodiment, the cross-linkable polymer system includes ethylene propylene diene monomer (EPDM) with a suitable photoinitiator. In an embodiment, the cross-linkable polymer system is uncured, i.e. does not further cure after coating. In another embodiment, the cross-linkable polymer system is cured by any suitable means such as ultraviolet (UV) cure, thermal cure, condensation cure, and the like. The cross-linkable polymer system may include optional components such as initiators, fillers and colorants, stabilizers, flame retardants, adhesion promoters, or any combinations thereof.

In an embodiment, the adhesion promoting layer is formed from a blend of polymers. For instance, the adhesion promoting layer is a blend of a polar thermoplastic material. In an embodiment, the adhesion promoting layer is a blend of a copolymer of ethylene methylacrylic acid and a terpolymer of ethylene, acrylic ester, and maleic anhydride. In another embodiment, the adhesion promoting layer is a blend of a polar thermoplastic material and a cross-linkable polymer. For instance, the adhesion promoting layer is a blend of a copolymer of ethylene methylacrylic acid and an ethylene vinyl silane copolymer. In another embodiment, the adhesion promoting layer is a blend of a copolymer of ethylene methylacrylic acid and an ethylene propylene diene monomer. The blend of polymers typically includes polar thermoplastic material of at least about 20 weight % of the total weight of the adhesion promoting layer, such as at least about 30 weight %, at least about 40 weight %, at least about 50 weight %, or at least about 70 weight % of the total weight of the adhesion promoting layer. The blend may include optional components such as fillers and colorants, stabilizers, flame retardants, adhesion promoters, or any combination thereof.

Typically, the adhesion promoting layer 104 has a thickness of at least about 10 microns, such as at least about 25 microns. For example, the thickness of the adhesion promoting layer 104 may be in a range of about 25 microns to about 150 microns, such as about 25 microns to about 100 microns, or about 25 microns to about 50 microns. In an embodiment, the thickness ratio of the thickness of the adhesion promoting layer 104 compared to the thickness of the backing may be not greater than about 1:30, such as about 1:12. In an embodiment, the thickness ratio of the thickness of the adhesion promoting layer 104 compared to the thickness of the backing may be not greater than about 1:5, such as not greater than about 1:4, or even not greater than about 1:3.

The backing 102 of the abrasive article may be flexible or rigid and may be made of various materials. An exemplary flexible backing includes a polymeric film (for example, a primed film), such as polyolefin film (e.g., polypropylene including biaxially oriented polypropylene), polyester film (e.g., polyethylene terephthalate), polyamide film, or cellulose ester film; metal foil; mesh; foam (e.g., natural sponge material or polyurethane foam); cloth (e.g., cloth made from fibers or yarns comprising polyester, nylon, silk, cotton, polycotton, or rayon); paper; vulcanized paper; vulcanized rubber; vulcanized fiber; nonwoven materials; any combination thereof, or any treated version thereof. Cloth backings may be woven or stitch bonded. In particular examples, the backing is selected from the group consisting of paper, polymer film, cloth, cotton, poly-cotton, rayon, polyester, poly-nylon, vulcanized rubber, vulcanized fiber, metal foil or any combination thereof. In an exemplary embodiment, the backing includes a thermoplastic film, such as a polyethylene terephthalate (PET) film. In particular, the backing may be a single layer polymer film, such as a single layer PET film. An exemplary rigid backing includes a metal plate, a ceramic plate, or the like.

In an embodiment, the backing may be treated to improved adhesion between the adhesion promoting layer 104 and the backing 102, as represented by the primer layer 120. In an embodiment, the treatment may include surface treatment, chemical treatment, use of a primer, or any combination thereof. In an exemplary embodiment, the treatment may include corona treatment, UV treatment, electron beam treatment, flame treatment, scuffing, or any combination thereof. An exemplary primer may include a chemical primer that increases adhesion between the backing 102 and the adhesion promoting layer 104. An exemplary chemical primer is a polyethylene imine primer. Typically, a chemical primer has a thickness of not greater than about 5 microns, such as not greater than about 3 microns, such as not greater than about 2.5 microns.

Typically, the backing 102 has a thickness of at least about 50 microns, such as greater than about 75 microns. For example, the backing 102 may have a thickness of greater than about 75 microns and not greater than about 200 microns, or greater than about 75 microns and not greater than about 150 microns.

The abrasive layer 108 may be formed as one or more coats. Generally, the abrasive layer 108 is formed of a binder, also referred to as a make coat (layer 108), and abrasive grains 110 that overlie a major surface 112 of the adhesion promoting layer 104. In an exemplary embodiment, the abrasive grains 110 are blended with the binder formulation to form abrasive slurry. Alternatively, the abrasive grains 110 are applied over the binder formulation after the binder formulation is coated over the major surface 112 of the adhesion promoting layer 104. Particular coated abrasives include engineered or structured abrasives that generally include patterns of abrasive structures. Optionally, a functional powder may be applied over the abrasive layer 108 to prevent the abrasive layer 108 from sticking to a patterning tooling. Alternatively, patterns may be formed in the abrasive layer 108 absent the functional powder.

The binder may be formed of a single polymer or a blend of polymers. The binder can be used to form a make coat, a size coat, a supersize coat, or any combination thereof. In addition, the binder formulation may be coated to underlie the backing and cured to form a cured back coat. For example, the binder may be formed from epoxy, acrylic polymer, or a combination thereof. In addition, the binder may include filler, such as nano-sized filler or a combination of nano-sized filler and micron-sized filler. In a particular embodiment, the binder includes a colloidal binder, wherein the formulation that is cured to form the binder is a colloidal suspension including particulate filler. Alternatively, or in addition, the binder may be a nanocomposite binder or coating material including sub-micron particulate filler.

The binder generally includes a polymer matrix, which binds the abrasive grains to the adhesion promoting layer 104. Typically, the binder is formed of cured binder formulation. For the preparation of the polymer component, the binder formulation may include one or more reaction constituents or polymer constituents. A polymer constituent may include a monomeric molecule, an oligomeric molecule, a polymeric molecule, or a combination thereof. The binder formulation may further include components such as dispersed filler, solvents, plasticizers, chain transfer agents, catalysts, stabilizers, dispersants, curing agents, reaction mediators, or agents for influencing the fluidity of the dispersion.

The polymer constituents can form thermoplastics or thermosets. By way of example, the polymer constituents may include monomers and resins for the formation of polyurethane, polyurea, polymerized epoxy, polyester, polyimide, polysiloxanes (silicones), polymerized alkyd, styrene-butadiene rubber, acrylonitrile-butadiene rubber, polybutadiene, or, in general, reactive resins for the production of thermoset polymers. Another example includes an acrylate or a methacrylate polymer constituent. The precursor polymer constituents are typically polymerizable organic material. A precursor polymer constituent example includes a reactive constituent for the formation of an amino polymer or an aminoplast polymer, such as alkylated urea-formaldehyde polymer, melamine-formaldehyde polymer, and alkylated benzoguanamine-formaldehyde polymer; acrylate polymer including acrylate and methacrylate polymer, alkyl acrylate, acrylated epoxy, acrylated urethane, acrylated polyester, acrylated polyether, vinyl ether, acrylated oil, or acrylated silicone; alkyd polymer such as urethane alkyd polymer; polyester polymer; reactive urethane polymer; phenolic polymer such as resole and novolac polymer; phenolic/latex polymer; epoxy polymer such as bisphenol epoxy polymer; isocyanate; isocyanurate; polysiloxane polymer including alkylalkoxysilane polymer; reactive vinyl polymer; or any combination thereof. In a particular embodiment, the binder formulation includes monomers of at least two types of polymers that when cured may crosslink. For example, the binder formulation may include epoxy constituents and acrylate constituents that when cured form an epoxy/acrylate polymer.

In an exemplary embodiment, the polymer reaction components include anionically and cationically polymerizable components. For example, the binder formulation may include at least one cationically polymerizable component, e.g., at least one cyclic ether component, cyclic lactone component, cyclic acetal component, cyclic thioether component, spiro orthoester component, epoxy-functional component, or oxetane-functional component. In a particular embodiment, the binder formulation includes at least one component of an epoxy-functional component or an oxetane-functional component. The binder formulation may include, relative to the total weight of the binder formulation, at least about 10.0 wt % of a cationically polymerizable component, for example, at least about 20.0 wt %, typically, at least about 40.0 wt %, or at least about 50.0 wt % of the cationically polymerizable component. Generally, the binder formulation includes, relative to the total weight of the binder formulation, not greater than about 95.0 wt % of a cationically polymerizable component, for example, not greater than about 90.0 wt %, not greater than about 80.0 wt %, or not greater than about 70.0 wt % of the cationically polymerizable component. In general, the amounts of components are expressed as weight % of the component relative to the total weight of the binder formulation, unless explicitly stated otherwise.

In addition to or instead of one or more cationically polymerizable components, the binder formulation may include one or more free radical polymerizable components, e.g., one or more free radical polymerizable components having one or more ethylenically unsaturated groups, such as (meth)acrylate (i.e., acrylate or methacrylate) functional components. In an embodiment, the free radical polymerizable component is a monofunctional ethylenically unsaturated component or a polyfunctional ethylenically unsaturated component. In an embodiment, the binder formulation comprises one or more components having at least 3 (meth)acrylate groups, for example, 3 to 6 (meth)acrylate groups, or 5 to 6 (meth)acrylate groups. In particular embodiments, the coating formulation includes, relative to the total weight of the coating formulation, at least about 3.0 wt % of one or more free radical polymerizable components, for example, at least about 5.0 wt % or at least about 9.0 wt % of the one or more free radical polymerizable components. Generally, the coating formulation includes not greater than about 50.0 wt % of a free radical polymerizable component, for example, not greater than about 35.0 wt %, not greater than about 25.0 wt %, not greater than about 20.0 wt %, or even not greater than about 15.0 wt % of the free radical polymerizable component.

In an embodiment, the binder formulation may include a component having a polyether backbone. An example of a compound having a polyether backbone includes polytetramethylenediol, a glycidylether of polytetramethylenediol, an acrylate of polytetramethylenediol, a polytetramethylenediol containing one or more polycarbonate groups, or any combination thereof. In an exemplary embodiment, the binder formulation includes between 5.0 wt % and 20.0 wt % of a compound having a polyether backbone.

The binder formulation also may include a curing agent, such as a catalyst or a initiator. For example, the curing agent may include a cationic catalytic agent, such as a cationic initiator. In an example, a cationic initiator may catalyze reactions between cationic polymerizable components. In another example, the curing agent may include a radical initiator that may activate free-radical polymerization of radically polymerizable components. The initiator may be activated by thermal energy or actinic radiation. For example, an initiator may include a cationic photoinitiator that catalyzes cationic polymerization reactions when exposed to actinic radiation. Examples of cationic photoinitiators include, for example, onium salt with anions of weak nucleophilicity and organometallic salts. In another example, the initiator may include a radical photoinitiator that initiates free-radical polymerization reactions when exposed to actinic radiation. Actinic radiation includes particulate or non-particulate radiation and is intended to include electron beam radiation and electromagnetic radiation. In a particular embodiment, electromagnetic radiation includes radiation having at least one wavelength in the range of about 100 nm to about 700 nm and, in particular, wavelengths in the ultraviolet range of the electromagnetic spectrum.

In particular examples, the binder formulation may include, relative to the total weight of the binder formulation, less than about 20.0 wt %, such as about 0.1 wt % to about 20.0 wt % of one or more initiators, for example, about 1.0 wt % to about 15.0 wt % of the one or more initiators, or about 1.0 wt % to about 10.0 wt % of the one or more initiators, or about 0.1 wt % to 2.0 wt % of the one or more initiators, based on the total weight of the binder formulation. Optionally, organometallic salt catalysts can be used and accompanied by an accelerator, such as an oxalate ester of a tertiary alcohol. If present, the accelerator desirably comprises from about 0.1% to about 4.0% by weight of the total binder formulation.

Optionally, a thermal curative may be included in the binder formulation. Such a thermal curative is generally thermally stable at temperatures at which mixing of the components takes place. A thermal curative may be present in a binder formulation in any effective amount. Such amounts are typically in the range of about 0.01 wt % to about 5.0 wt %, desirably in the range from about 0.025 wt % to about 2.0 wt % by weight, based upon the weight of the binder formulation, although amounts outside of these ranges may also be useful.

In another example, the binder formulation may include additional components, such as a hydroxy-functional or an amine functional component or additive. Generally, the particular hydroxy-functional component is absent curable groups (such as, for example, acrylate-, epoxy-, or oxetane groups) and are not selected from the group consisting of photoinitiators. A hydroxy-functional component may be helpful in further tailoring mechanical properties of the coating formulation upon cure. A hydroxy-functional component include a monol (a hydroxy-functional component comprising one hydroxy group) or a polyol (a hydroxy-functional component comprising more than one hydroxy group). An exemplary hydroxy-functional component includes polyether or polyester.

For the purpose of influencing the viscosity of the binder formulation and, in particular, viscosity reduction or liquefaction, a polyol, polyether or saturated polyester or mixtures thereof, where appropriate, may be admixed with a further suitable auxiliary, particularly a solvent, a plasticizer, a diluent or the like. In an embodiment, the compositions may comprise, relative to the total weight of the binder formulation, not greater than about 15.0 wt %, such as not greater than about 10.0 wt %, not greater than about 6.0 wt %, not greater than about 4.0 wt %, not greater than about 2.0 wt %, or about 0.0 wt % of a hydroxy-functional component. In an example, the binder formulations are free of substantial amounts of a hydroxy-functional component. The absence of substantial amounts of hydroxy-functional components may decrease the hygroscopicity of the binder formulations or articles obtained therewith.

The binder formulation further may include a dispersant for interacting with and modifying the surface of a particulate filler. For example, a dispersant may include organosiloxane, functionalized organisiloxane, alkyl-substituted pyrrolidone, polyoxyalkylene ether, ethyleneoxide propyleneoxide copolymer, or any combination thereof. For various particulate fillers and, in particular, for silica filler, a suitable surface modifier includes siloxane.

The amount of dispersant may range from 0.0 wt % to 5.0 wt %. More typically, the amount of dispersant is between 0.1 wt % and 2.0 wt %. The silanes are typically used in concentrations from 40.0 mol % to 200.0 mol % and, particularly, 60.0 mol % to 150.0 mol % relative to the molecular quantity surface active sites on the surface of a nano-sized particulate filler. Generally, the binder formulation includes not greater than about 5.0 wt % dispersant, such as about 0.1 wt % to about 5.0 wt % dispersant, based on the total weight of the binder formulation.

The binder formulation may further include a dispersed phase suspended in an external phase. The external phase typically includes the polymer constituents. The dispersed phase generally includes particulate filler. The particulate filler may be formed of inorganic particles. In a particular embodiment, the coating formulation may include at least two particulate fillers. The particulate fillers may be of the same material or of different materials. Further, the particular fillers may be of the same size or of different sizes.

In a particular embodiment, the particulate filler has an average particle size of less than about 1500 nm, such as less than about 1000 nm, such as less than about 500 nm, or about 1 nm to about 500 nm. In an exemplary embodiment, the particulate filler has an average particle size about 3 nm to about 200 nm, such as about 3 nm to about 100 nm, about 3 nm to about 50 nm, about 8 nm to about 30 nm, or about 10 nm to about 25 nm. In particular embodiments, the average particle size is not greater than about 500 nm, such as not greater than about 200 nm, less than about 100 nm, or not greater than about 50 nm.

In addition to the above constituents, other components may also be added to the binder formulation, including, for example, anti-static agents, such as graphite, carbon black, and the like; suspending agents, such as fumed silica; anti-loading agents, such as zinc stearate; lubricants such as wax; wetting agents; dyes; fillers; viscosity modifiers; dispersants; defoamers; or any combination thereof.

To form an abrasive layer, abrasive grains may be included within the binder or deposited over the binder. The abrasive grains may be formed of any one of or a combination of abrasive grains, including silica, alumina (fused or sintered), zirconia, zirconia/alumina oxides, silicon carbide, garnet, diamond, cubic boron nitride, silicon nitride, ceria, titanium dioxide, titanium diboride, boron carbide, tin oxide, tungsten carbide, titanium carbide, iron oxide, chromia, flint, emery, or any combination thereof. For example, the abrasive grains may be selected from a group consisting of silica, alumina, zirconia, silicon carbide, silicon nitride, boron nitride, garnet, diamond, cofused alumina zirconia, ceria, titanium diboride, boron carbide, flint, emery, alumina nitride, or a blend thereof. In a further example, the abrasive grain may be formed of an agglomerated grain. Particular embodiments have been created by use of dense abrasive grains comprised principally of alpha-alumina.

The abrasive grain may also have a particular shape. An example of such a shape includes a rod, a triangle, a pyramid, a cone, a solid sphere, a hollow sphere or the like. Alternatively, the abrasive grain may be randomly shaped.

The abrasive grains generally have an average grain size not greater than 2000 microns, such as not greater than about 1500 microns. In another example, the abrasive grain size is not greater than about 750 microns, such as not greater than about 350 microns. For example, the abrasive grain size may be at least 0.1 microns, such as from about 0.1 microns to about 1500 microns, and more typically from about 0.1 microns to about 200 microns, or from about 1 micron to about 100 microns. The grain size of the abrasive grains is typically specified to be the longest dimension of the abrasive grain. Generally, there is a range distribution of grain sizes. In some instances, the grain size distribution is tightly controlled.

In a blended abrasive slurry including the abrasive grains and the binder formulation, the abrasive grains provide from about 10.0% to about 90.0%, such as from about 30.0% to about 80.0%, of the weight of the abrasive slurry.

The abrasive slurry further may include a grinding aid to increase the grinding efficiency and cut rate. A useful grinding aid can be inorganic based, such as a halide salt, for example, sodium cryolite, and potassium tetrafluoroborate; or organic based, such as a chlorinated wax, for example, polyvinyl chloride. A particular embodiment of grinding aid includes cryolite and potassium tetrafluoroborate with particle size ranging from 1 micron to 80 microns, and most typically from 5 microns to 30 microns. The weight percent of grinding aid is generally not greater than about 50.0 wt %, such as from about 0.0 wt % to 50.0 wt %, and most typically from about 10.0 wt % to 30.0 wt % of the entire slurry (including the abrasive grains).

To form an abrasive article, such as the exemplary abrasive article illustrated in FIG. 1, the adhesion promoting layer 104 is coated onto a backing 102. Coating may include extrusion coating, emulsion coating, or solution coating. In an exemplary process, the adhesion promoting layer 104 is extrusion coated onto the backing 102. Prior to coating the adhesion promoting layer 104, the backing 102 may be treated to increase the adhesion between the adhesion promoting layer and the backing. The binder formulations may be disposed directly on the adhesion promoting layer as a make coat. In an exemplary process for forming the make coat 108, the binder formulation is coated on the adhesion promoting layer 104, abrasive grains are applied over the make coat 108, and the make coat 108 is at least partially cured. The abrasive grains may be provided following coating of the adhesion promoting layer with the binder formulation, after partial curing of the binder formulation, after patterning of the binder formulation, or after fully curing the binder formulation. The abrasive grains may, for example, be applied by a technique, such as electrostatic coating, drop coating or mechanical projection. In another exemplary embodiment, the binder formulation is blended with the abrasive grains to form abrasive slurry that is coated on the adhesion promoting layer 104, at least partially cured and optionally patterned.

Once the binder formulation is cured an abrasive article is formed. Alternatively, a size coat may be applied over the abrasive layer. In an embodiment, a size coat may be applied over the binder formulation and abrasive grains. For example, the size coat may be applied before partially curing the binder formulation, after partially curing the binder formulation, after patterning the binder formulation, or after further curing the binder formulation. The size coat may be applied by, for example, roll coating or spray coating. Depending on the composition of the size coat and when it is applied, the size coat may be cured in conjunction with the binder formulation or cured separately. A supersize coat including grinding aids may be applied over the size coat and cured with the binder formulation, cured with the size coat, or cured separately.

Further, a backsize formulation may be disposed on the surface of the backing 102 that is opposite the adhesion promoting layer 104. When curing, the backsize and binder formulations may be completely cured or may be at least partially cured and cured to completion at a later time.

In an example, the binder formulation may be patterned and cured. In a particular example, the binder formulation may be partially cured before patterning to increase the viscosity of the formulations before patterning. Alternatively, the binder formulation may have a viscosity prior to curing that permits pattern formation in the formulations as dispensed. Patterns may be imparted through a rotogravure, stamping, pressing, or embossing roll.

In an example, the binder formulation may be cured through an energy source. The selection of the energy source depends in part upon the chemistry of the formulations. The energy sources may be a source of thermal energy or actinic radiation energy, such as electron beam, ultraviolet light, or visible light. The amount of energy used depends on the chemical nature of the reactive groups in the precursor polymer constituents, as well as upon the thickness and density of the coating formulation. Curing parameters, such as exposure, are generally formulation dependent and can be adjusted via lamp power and belt speed.

In an exemplary embodiment, the abrasive article advantageously provides an improved Surface Finish Parameter. The Surface Finish Parameter is defined as the surface finish ($R_a$ or $R_z$) as determined by an internal crankshaft grinding test in accordance with the method of Example 4 below. For instance, the Surface Finish Parameter ($R_a$) of the abrasive article on a steel workpiece may be less than about 0.200 microns, such as less than about 0.180 microns. The Surface Finish Parameter ($R_z$) of the abrasive article on the steel workpiece may be less than about 2.000 microns, such as less than about 1.700 microns. When the abrasive article is tested on a nodular iron workpiece, the Surface Finish Parameter ($R_a$) may be less than about 0.120 microns, such as less than about 0.110 microns. The Surface Finish Parameter ($R_z$) of the abrasive article on the nodular iron workpiece may be less than about 1.000 microns, such as less than about 0.880 microns.

Example 1

Two adhesion promoting layers are prepared for a performance study. Specifically, two polar thermoplastic materials at a thickness of 25 microns are extruded onto a 75 micron polyethylene terephthalate (PET) backing. Technical data of the polar thermoplastic material is illustrated in Table 1. A comparison sample control film of Q151 (a PET film coated with water based UV cured polyurethane (Neorad 3709) with fused silica filler (Minsil 20)) of about 50 microns to 60 microns in thickness is also used.

TABLE 1

Properties of Polar Thermoplastic of Adhesion Promoting Layers

| | Polar Thermoplastic | Functionality |
|---|---|---|
| Eastman SP2207 | Ethylene methylacrylic acid | 20% methylacrylic acid |
| Dow Amplify 101 | Ethylene ethylacrylic acid | 22% ethylacrylic acid |

The coolant fluid resistance of the adhesion promoting layers is evaluated. The samples are tested at room temperature with about 20 minutes of direct exposure to three coolant fluids: mineral seal oil, Syntilo 9930/diionized water mix (20/80 ratio), Syntilo 9930. The Syntilo is a coolant available from Castrol. The amount of coolant fluid is about 5 ml to about 10 ml and the surface of the adhesion promoting layer is rubbed with a letter opener in an attempt to delaminate the coating. The adhesion promoting layers are not affected by the coolant fluids. The two samples are well wet by the fluids but did not swell, distort, or separate from the PET film.

Example 2

Five articles are prepared for a performance study. Specifically, the two polar thermoplastic materials described in Example 1 are extruded at a thickness of 25 microns onto a 75 micron polyethylene terephthalate (PET) backing. The composition of the coated articles can be seen in Table 2. The backcoats have a thickness of 50 microns. A comparison sample control film of Q154 (a 5 MIL PET film coated with water based UV cured polyurethane (Neorad 3709) with fused silica filler (Minsil 20)) is also used.

TABLE 2

Composition of Articles

| | Backcoat | Adhesion promoting layer |
|---|---|---|
| Article 1 | Standard water based UV cured polyurethane (Neorad 3709) with fused silica filler (Minsil 20) | DOW Amplify 101 |
| Article 2 | Low density polyethylene (LDPE) Dow 722 | Eastman SP2207 |
| Article 3 | LDPE Dow 722/Kraton FG 1901 blend | Eastman SP2207 |
| Article 4 | Ethylene propylene diene monomer (EPDM) Dow Nordel 4820P | Eastman SP2207 |
| Article 5 | LDPE Dow 722/Kraton FG 1901 blend | DOW Amplify 101 |

All films are corona treated to about 48-55 dyne/cm$^2$ and coated with MICA AX131 polyethylene imine primer at 0.6 lb/ream (3000 ft$^2$/ream) prior to extrusion coating with adhesion promoting layers.

The coolant fluid resistance of the adhesion promoting layers are evaluated for Articles 1, 2, and 3. A four inch length of each sample is exposed to Castrol Honilo 480 C and Castrol Honilo 980 for a period of 24 hours. The bottom inch of the sample is left immersed in the liquid, while the top three inches is allowed to "drip dry". Drip-dried areas do not achieve complete dryness. Samples are inspected after 3.25 hours, 6 hours, 24 hours, and 144 hours. After 24 hours and 144 hours, the dry end of each sample is compared to the wet end of each sample by measuring thickness. Results can be seen in Table 3 and Table 4.

TABLE 3

Thickness of Article After Immersion in Honilo 480C

| | Sample | | |
|---|---|---|---|
| | Dry End | Wet End (24 hours) | Wet End (144 hours) |
| Control | 15 mil | 14.5 mil | 14.5 mil |
| Article 1 | 17 mil | 16.5 mil | 16.5 mil |
| Article 2 | 17 mil | 17.5 mil | 17.5 mil |
| Article 3 | 17 mil | 17 mil | 17.5 mil |

TABLE 4

Thickness of Article After Immersion in Honilo 980

| | Sample | | |
|---|---|---|---|
| | Dry End | Wet End (24 hours) | Wet End (144 hours) |
| Control | 15 mil | 15 mil | 14.9 mil |
| Article 1 | 17 mil | 17 mil | 17 mil |
| Article 2 | 17 mil | 17 mil | 17.2 mil |
| Article 3 | 16.5 mil | 17 mil | 17.2 mil |

The variation in the thickness of the dry and wet ends are considered within sample variation after both 24 and 144 hours. No difference in appearance is noted. The three articles demonstrate equivalent coolant resistance compared to the control sample.

The adhesion of the finished coatings is evaluated for Articles 1 through 5. The adhesion of the finished coatings is significantly better on all samples which contain the adhesion promoting layer compared to the control sample.

Example 3

Three abrasive articles are prepared for adhesion testing. The composition of the abrasive articles are as follows:

Abrasive Article 1: NORaX UV cured acrylic formulation (3 and 6 MIL) on Dow Amplify 101 EEA copolymer coated 5 MIL PET film (corona treated/MICA A131X primer).

Abrasive Article 2: Q351 Hybrid Cationic UV cured epoxy acrylic make and size resins (3 mil make/BFRPL (blue fired heat treated aluminum oxide) P180 grain/size) on Exxon TC 221 EMA (27% MA content) copolymer coated 5 MIL PET film (corona treated/MICA A131X primer).

Abrasive Article 3: Q156 (3 mil make UV cured acrylic resin/BFRPL (blue fired heat treated aluminum oxide) P180/UV cured acrylic resin/size) on Dow Amplify 101 EEA copolymer coated PET film (corona treated/MICA A131X primer).

Control 1: Q156 without adhesion promoting layer.

Control 2: NORaX UV cured acrylic formulation without an adhesion promoting layer.

The articles are flexed by hand to determine the adhesion of the make layer and abrasive grains with and without an adhesion promoting layer. With both control samples without the adhesion promoting layer, the make layer delaminated from the backing when flexed. The three abrasive articles containing the adhesion promoting layer do not have delamination of the make layer from the backing after flex.

Example 4

An abrasive article is prepared for performance testing (Abrasive Article 4). A Mylar A PET film having a thickness of 125 microns is corona treated on both sides and MICA A131X primer is applied to both sides. An adhesion promoting layer of Eastman SP2207 plus 2 wt % white concentrate (for tinting purposes) is extruded at 25 microns thickness on the Mylar A PET film. A 50 micron thick backcoat of a Dow LDPE 722 is applied to the backing. Further, a UV cured acrylic make coat, 40 micron aluminum oxide grain and UV cured acrylic size coat are applied over the adhesion promoting layer.

The samples are further tested for stock removal and finishing. An abrasive tape having dimensions 1 inch by 30 inches is placed in a microfinisher test apparatus. A 1.983 inch diameter workpiece ring formed of 1045 steel or nodular iron is inserted into the apparatus. During testing the workpiece rotates about its central axis in both directions and also oscillates back and forth along the central axis. Mineral seal oil is applied to the workpiece as a coolant. A shoe formed of segmented India stone supplied by IMPCO provides back support to the abrasive tape. The microfinisher settings include the driver motor key set at 1.25, the number of revolutions set at 14, the oscillation motor key set at 2.5 and the pressure set at 75 psi. These conditions provide a cycle time of approximately 5 seconds at 210 RPM and a 5 HZ oscillation.

Prior to testing the workpiece rings are washed using a non-abrasive cleaner and are air-dried. An initial measurement of the ring and ring surface is taken. The weight of the ring is measured using a Toledo PB 303 scale. The surface quality is measured using a Taylor-Hobson Surtronic 3+. The rings are mounted into the apparatus and the abrasive tape is inserted. The rings are ground for 5 seconds in each direction and are then washed and measured.

Results of the Surface Finish Parameters with the Steel workpiece can be seen in Table 5. Results of the Surface Finish Parameters with the Nodular Iron workpiece can be seen in Table 6.

TABLE 5

Surface Finish Parameters with Steel Workpiece

| Test | Control | Abrasive Article 4 |
|---|---|---|
| Stock removal | 0.082 +/− 0.006 grams | 0.092 +/− 0.004 grams |
| Incoming Surface Finish (Ra) Parameter | 0.408 +/− 0.023 microns | 0.380 +/− 0.041 microns |
| Outgoing Surface Finish (Ra) Parameter | 0.220 +/− 0.017 microns | 0.180 +/− 0.025 microns |
| Incoming Surface Finish (Rz) Parameter | 3.640 +/− 0.456 microns | 3.460 +/− 0.378 microns |
| Outgoing Surface Finish (Rz) Parameter | 2.220 +/− 0.259 microns | 1.700 +/− 0.292 microns |

As illustrated in Table 5, the sample including the adhesion promoting layer surprisingly exhibits improved stock removal and lower Surface Finish Parameters (Ra and Rz) than the comparative sample. Incoming Surface Finish Parameters (Ra and Rz) illustrate that the starting finish is about equivalent for both micro-finishing products.

TABLE 6

Surface Finish Parameters with Nodular Iron Workpiece

| Test | Control | Abrasive Article 4 |
|---|---|---|
| Stock removal | 0.365 +/− 0.034 grams | 0.341 +/− 0.044 grams |
| Incoming Surface Finish (Ra) Parameter | 0.340 +/− 0.019 microns | 0.334 +/− 0.029 microns |
| Outgoing Surface Finish (Ra) Parameter | 0.154 +/− 0.011 microns | 0.108 +/− 0.013 microns |
| Incoming Surface Finish (Rz) Parameter | 2.960 +/− 0.288 microns | 3.100 +/− 0.354 microns |
| Outgoing Surface Finish (Rz) Parameter | 1.500 +/− 0.200 microns | 0.880 +/− 0.084 microns |

Results for the nodular iron workpiece suggest that the stock removal is about equivalent with Abrasive Article 4 compared to the control. Incoming surface roughness (Ra and Rz) are about equivalent for both micro-finishing products. Surface Finish Parameters (Ra and Rz) are better for Abrasive Article 4 compared to the control.

Example 5

Six samples are prepared for performance testing. Blends of different polymers are prepared using a Brabender mixer. Plaques of approximately 1.5 mm thickness are compression molded using a Carver press. All six samples are a Q351 Hybrid Cationic UV cured epoxy acrylic make and size resins (3 mil make/BFRPL (blue fired heat treated aluminum oxide) P180 grain/size) on an adhesion promoting layer of a blended polymer coating a 5 MIL PET film (corona treated/MICA A131X primer). Composition data for the blends for the six adhesion promoting layers can be seen in Table 7.

TABLE 7

Composition of Adhesion Promoting Layer

| Article # | Article ID | Adhesion promoting layer |
|---|---|---|
| Article 6 | SP2207 | Eastman SP 2207 |
| Article 7 | SP2207_3210 | SP2207 (92%) + Lotader 3210 (8%) |
| Article 8 | 16MA003_3210 | Lotryl 16MA003 (92%) + Lotader 3210 |
| Article 9 | AQ120000 | Ethylene vinylsilane copolymer (PE-VMS) |
| Article 10 | AQ120000_SP2207 | PE-VMS (70%) + SP2207 (30%) + catalyst masterbatch |
| Article 11 | AQ120000_SP2207_CURED | PE-VMS (70%) + SP2207 (30%) + catalyst masterbatch, cured for 24 hrs at 65° C. & 95% RH |

TA Instruments Q800 Dynamic Mechanical Analyzer (S/N 0800-0161) is used to determine shear storage modulus. Shear storage modulus (G') of different samples is determined at constant strain using shear sandwich clamps. The test parameters shown in Table 8 are used.

TABLE 8

DMA Test Parameters

| | |
|---|---|
| Mode | Multi-Frequency Sweep-Strain Control |
| Test | Temperature Ramp/Frequency Sweep |
| Clamp | Shear sandwich |
| Amplitude | 10 μm |
| Temperature Range | Room Temperature to 70° C. |
| Rate | 3.00° C./minute |
| Frequency | Single, 1.0 Hz |

Figure 2:
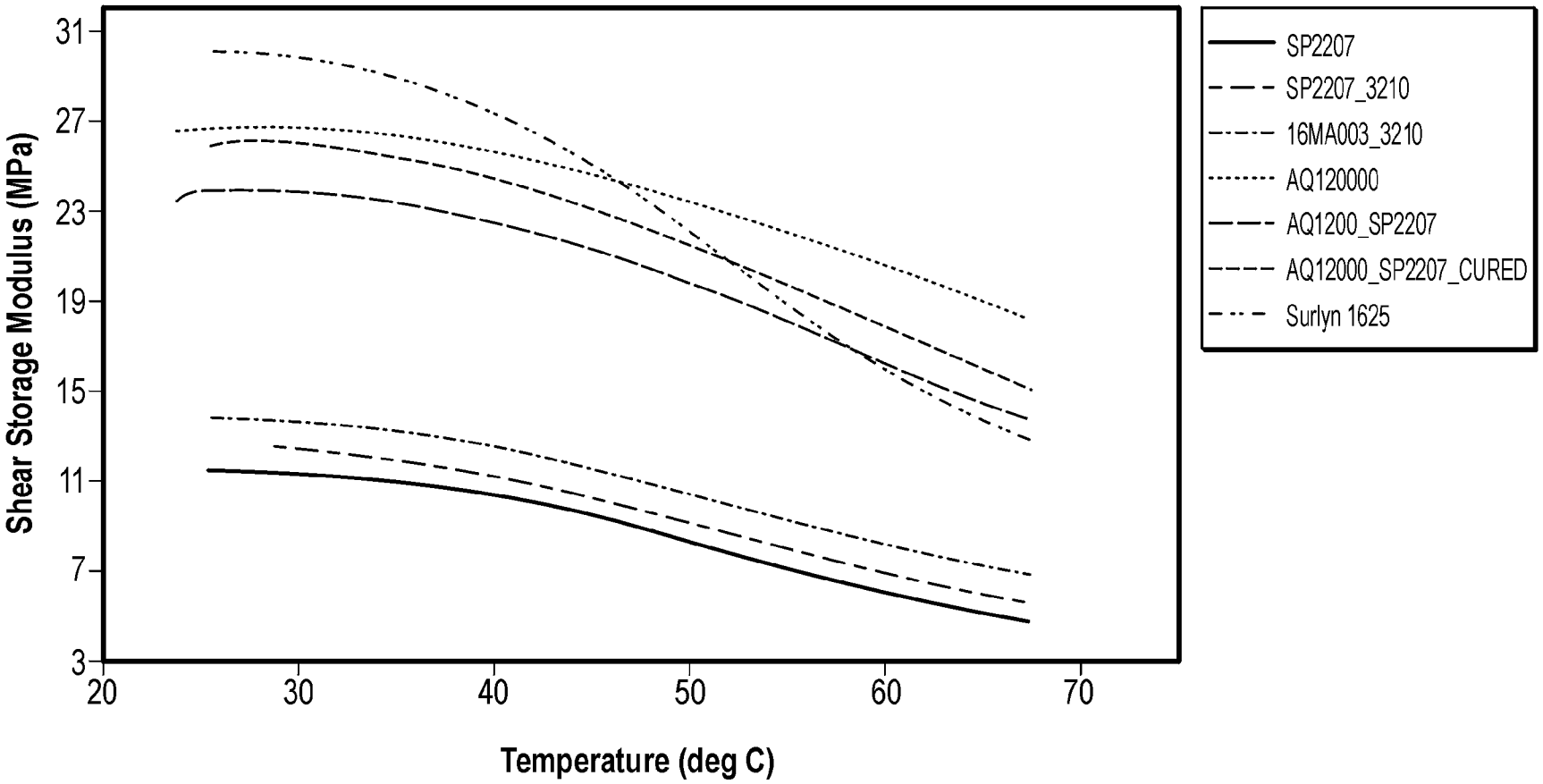
FIGS. 2 and 3 include graphical representations of shear storage modulus versus temperature as measured by DMA.

Additions of Lotader 3210 to SP2207 as well as 16MA003 increase the shear storage modulus of the blends only marginally over the temperature scan (see FIG. 2). AQ120000 (ethylene-vinylsilane copolymer) show high shear storage modulus. When SP2207 (30% wt) is blended in with AQ120000, shear storage modulus dips expectedly. Plaques of AQ120000+SP2207 blends are cured (crosslinking via hydrolysis & condensation) at 65° C. and 95% RH for 24 hrs. The cured sample shows higher shear storage modulus compared to that of uncured sample.

Example 6

Three samples are prepared for performance testing. Blends of different polymers are prepared using a Brabender mixer. Plaques of approximately 1.5 mm thickness are compression molded using a Carver press. All three samples are a Q351 Hybrid Cationic UV cured epoxy acrylic make and size resins (3 mil make/BFRPL (blue fired heat treated aluminum oxide) P180 grain/size) on an adhesion promoting layer of a blended polymer coating a 5 MIL PET film (corona treated/MICA A131X primer). Composition data for the blends for the three adhesion promoting layers can be seen in Table 9.

TABLE 9

Composition of Adhesion Promoting Layer

| Article # | Article ID | Adhesion promoting layer |
|---|---|---|
| Sample 12 | SP2207 | EMA |
| Sample 13 | EPDM_SP2207 | 30% EPDM/KIP150 masterbatch + |

TABLE 9-continued

| Composition of Adhesion Promoting Layer | | |
|---|---|---|
| Article # | Article ID | Adhesion promoting layer |
| | (uncured) | 70% SP2207 |
| Sample 14 | EPDM_SP2207 (cured) | 30% EPDM/KIP150 + 70% SP2207, cured using H bulb @ 15 m/min, 95% bulb intensity, 2 passes. |

Figure 3:
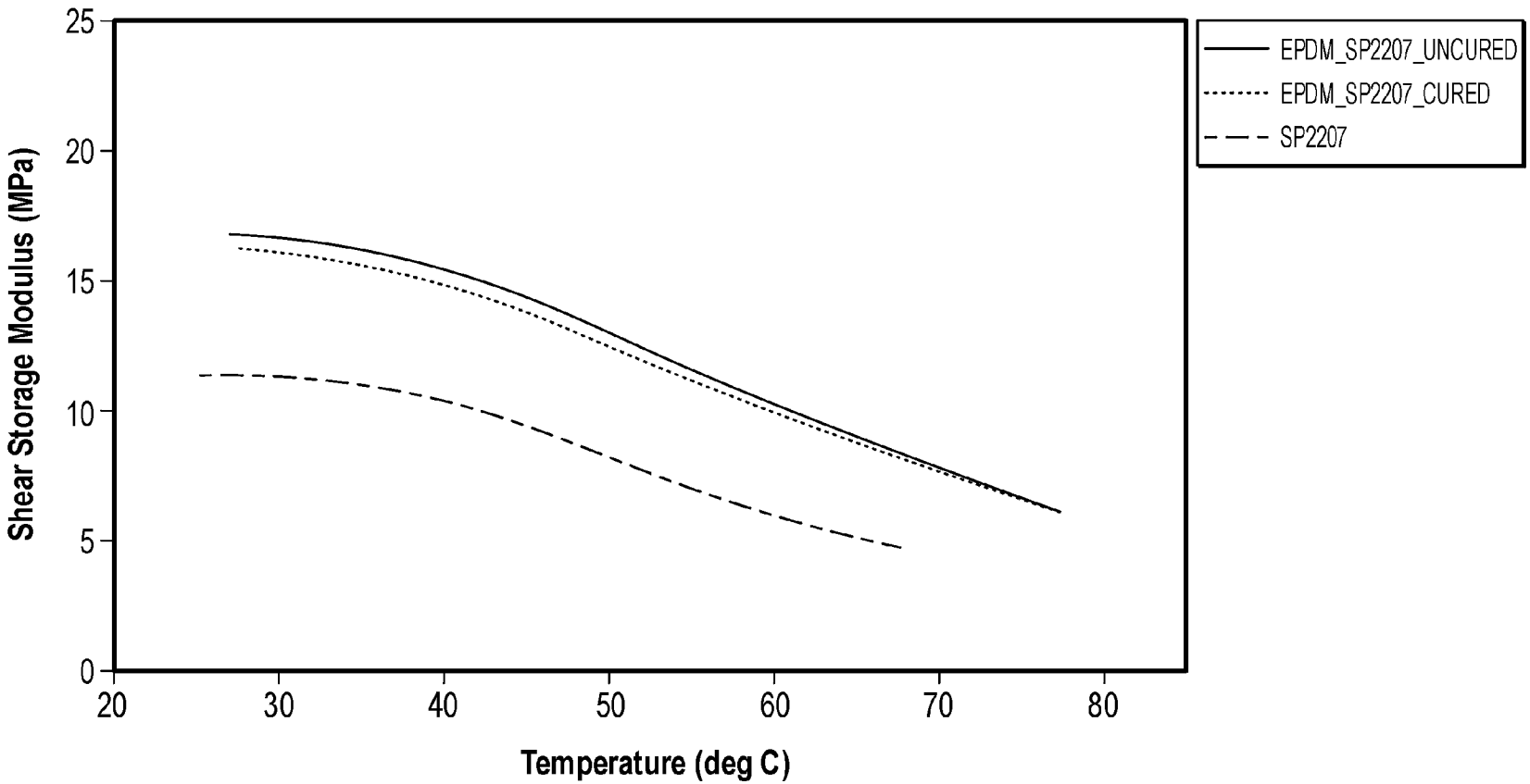

Shear storage modulus is measured in accordance with Example 5. Results can be seen in FIG. 3. The EPDM blends as seen in Samples 13 and 14 show high shear storage modulus. Plaques of EPDM+SP2207 blends are cured (crosslinking via UV). There is a marginally higher shear storage modulus of the uncured sample compared to that of cured sample.

The above-disclosed subject matter is to be considered illustrative, and not restrictive, and the appended claims are intended to cover all such modifications, enhancements, and other embodiments, which fall within the true scope of the present invention.

What is claimed is:

1. An abrasive article comprising:

a backing having a major surface;

an adhesion promoting layer, the adhesion promoting layer having a thickness of about 25 microns to about 50 microns and formed of a polar thermoplastic material;

a primer layer including polyethylene imine disposed between the adhesion promoting layer and the backing; and a make layer directly contacting the adhesion promoting layer, and abrasive grains disposed on or within the make layer, wherein the backing includes a corona treated polymer film, wherein the polar thermoplastic material includes a blend of a copolymer of ethylene and methyl acrylate and a terpolymer of ethylene, acrylic ester, and maleic anhydride.

2. The abrasive article of claim 1, wherein the adhesion promoting layer further includes a cross-linkable polymer that is ethylene propylene diene monomer (EPDM) or ethylene vinylsilane copolymer.

3. The abrasive article of claim 1, wherein the polymer film is a polyethylene terephthalate film.

4. The abrasive article of claim 1, having a Surface Finish ($R_a$) Parameter of less than about 0.200 microns for steel.

5. The abrasive article of claim 1, having a Surface Finish ($R_z$) Parameter of less than about 2.000 microns for steel.

6. The abrasive article of claim 1, having a Surface Finish ($R_a$) Parameter of less than about 0.120 microns for nodular iron.

7. The abrasive article of claim 1, having a Surface Finish ($R_z$) Parameter of less than about 1.000 microns for nodular iron.

8. An abrasive article comprising:

a corona treated backing having a major surface;

an adhesion promoting layer, the adhesion promoting layer having a thickness of about 25 microns to about 50 microns and formed of a polar thermoplastic material including a blend of a copolymer of ethylene and methyl acrylate and a terpolymer of ethylene, acrylic ester, and maleic anhydride;

a primer layer including polyethylene imine disposed between the adhesion promoting layer and the backing; and a make layer directly contacting the adhesion promoting layer, and abrasive grains disposed on or within the make layer.

9. The abrasive article of claim 8, wherein the primer layer includes a thickness of not greater than about 5 microns.

10. The abrasive article of claim 8, wherein the backing is corona treated to about 48-55 dyne/$cm^2$.

11. An abrasive article comprising:

a backing having a major surface;

an adhesion promoting layer, the adhesion promoting layer having a thickness of about 25 microns to about 50 microns and formed of a polar thermoplastic material;

a primer layer including polyethylene imine disposed between the adhesion promoting layer and the backing; and a make layer directly contacting the adhesion promoting layer, and abrasive grains disposed on or within the make layer, wherein the backing includes a corona treated polymer film, wherein the polar thermoplastic material includes an ethylene acrylic ester copolymer or an ethylene acrylic ester terpolymer, or blends thereof, and wherein the adhesion promoting layer further includes ethylene vinylsilane copolymer.

* * * * *

UNITED STATES PATENT AND TRADEMARK OFFICE

CERTIFICATE OF CORRECTION

PATENT NO. : 8,883,288 B2
APPLICATION NO. : 12/184815
DATED : November 11, 2014
INVENTOR(S) : Anthony C. Gaeta et al.

It is certified that error appears in the above-identified patent and that said Letters Patent is hereby corrected as shown below:

In the Specification

Table 7, column 14, please delete "Lotader 3210," and insert --Lotader 3210 (8%)--.

Signed and Sealed this
Twenty-ninth Day of September, 2015

Michelle K. Lee

Michelle K. Lee
*Director of the United States Patent and Trademark Office*